US009885129B2

(12) United States Patent
Ackroyd et al.

(10) Patent No.: US 9,885,129 B2
(45) Date of Patent: Feb. 6, 2018

(54) FABRIC AND METHOD OF MAKING THE SAME

(71) Applicant: Tempnology LLC, Portsmouth, NH (US)

(72) Inventors: Dennis Ackroyd, Casco, ME (US); Ryan Drew, Baltimore, MD (US)

(73) Assignee: Coolcore, LLC, Portsmouth, NH (US)

( * ) Notice: Subject to any disclaimer, the term of this patent is extended or adjusted under 35 U.S.C. 154(b) by 1327 days.

(21) Appl. No.: 13/653,216

(22) Filed: Oct. 16, 2012

(65) Prior Publication Data

US 2013/0037248 A1 Feb. 14, 2013

Related U.S. Application Data

(63) Continuation-in-part of application No. 12/334,682, filed on Dec. 15, 2008, now Pat. No. 8,440,119.
(Continued)

(51) Int. Cl.
*D03D 15/00* (2006.01)

(52) U.S. Cl.
CPC ..... *D03D 15/00* (2013.01); *D03D 15/0066* (2013.01); *D03D 15/0077* (2013.01); *D03D 15/0083* (2013.01); *D03D 15/0094* (2013.01); *D10B 2101/20* (2013.01); *D10B 2331/02* (2013.01); *D10B 2331/04* (2013.01); *D10B 2401/02* (2013.01); *D10B 2401/021* (2013.01); *D10B 2401/022* (2013.01);
(Continued)

(58) Field of Classification Search
CPC ..... A41D 13/0056; A61F 2007/108; A61F 2007/0257; A61F 2007/0258
See application file for complete search history.

(56) References Cited

U.S. PATENT DOCUMENTS 3,317,367 A 5/1967 Koller
4,465,730 A 8/1984 Okada
(Continued)

FOREIGN PATENT DOCUMENTS

CN 1224473 7/1999
CN 101798723 8/2010
(Continued)

OTHER PUBLICATIONS

International Search Report and Written in corresponding PCT application No. PCT/US2013/065125, dated Mar. 6, 2014, 7 pp.
(Continued)

*Primary Examiner* — Cassey D Bauer

(74) *Attorney, Agent, or Firm* — Caseiro Burke, LLC; Chris A. Caseiro

(57) ABSTRACT

A fabric for thermal management including the cooling of an object, such as a person's skin. The fabric is formed of a plurality of functional zones arranged to extend the period of cooling without the use of artificial cooling chemicals. The functional zones include one or more of three different functional zone types. The first type diverts moisture. The second type retains and stores moisture. The third type absorbs moisture. One of the functional zones may be punched to create perforations to provide fabric flexibility and to assist in liquid diversion from within the fabric. An anchor system facilitates retention of the fabric on the object.

14 Claims, 7 Drawing Sheets

Related U.S. Application Data

(60) Provisional application No. 61/014,973, filed on Dec. 19, 2007.

(52) U.S. Cl.
CPC .. *D10B 2401/14* (2013.01); *D10B 2403/0114* (2013.01); *D10B 2403/021* (2013.01); *D10B 2501/00* (2013.01); *D10B 2501/04* (2013.01); *D10B 2509/026* (2013.01); *Y10T 428/24008* (2015.01); *Y10T 428/24331* (2015.01); *Y10T 442/3106* (2015.04); *Y10T 442/3472* (2015.04); *Y10T 442/3976* (2015.04); *Y10T 442/40* (2015.04)

(56) References Cited

U.S. PATENT DOCUMENTS

| | | | | |
|---|---|---|---|---|
| 4,512,065 | A | 4/1985 | Otto | |
| 4,733,546 | A | 3/1988 | Toda | |
| 4,869,250 | A | 9/1989 | Bitterly | |
| 5,065,600 | A | 11/1991 | Byles | |
| 5,192,600 | A | 3/1993 | Pontrelli et al. | |
| 5,192,606 | A | 3/1993 | Proxmire et al. | |
| 5,217,782 | A | 6/1993 | Moretz et al. | |
| 5,306,536 | A † | 4/1994 | Moretz | |
| 5,364,382 | A | 11/1994 | Latimer et al. | |
| 5,509,915 | A | 4/1996 | Hanson et al. | |
| 5,606,746 | A * | 3/1997 | Shelton | A41D 13/0053 2/102 |
| 5,735,145 | A † | 4/1998 | Pernick | |
| 5,815,867 | A | 10/1998 | Keasler et al. | |
| 5,906,876 | A | 5/1999 | Conway | |
| 6,156,072 | A | 12/2000 | Usui et al. | |
| 6,427,493 | B1 | 8/2002 | Kasdan et al. | |
| 6,432,504 | B1 | 8/2002 | Yeh | |
| 6,446,472 | B2 | 9/2002 | West et al. | |
| 6,837,078 | B1 | 1/2005 | Rock et al. | |
| 6,918,140 | B1 | 7/2005 | Cooper | |
| 6,927,182 | B2 | 8/2005 | Rock et al. | |
| 2001/0027071 | A1 * | 10/2001 | Bumbarger | A41D 31/0027 442/85 |
| 2002/0112499 | A1 | 8/2002 | Goldfine | |
| 2003/0186610 | A1 | 10/2003 | Peters et al. | |
| 2003/0208831 | A1 | 11/2003 | Lazar et al. | |
| 2005/0034330 | A1 | 2/2005 | Baychar | |
| 2007/0141940 | A1 † | 6/2007 | Baychar | |
| 2008/0096001 | A1 | 4/2008 | Emden et al. | |
| 2008/0201915 | A1 | 8/2008 | Obiols et al. | |
| 2009/0163099 | A1 | 6/2009 | Ackroyd et al. | |
| 2009/0191383 | A1 | 7/2009 | Kluge et al. | |
| 2010/0255270 | A1 | 10/2010 | Stuebiger | |
| 2012/0190259 | A1 | 7/2012 | Frost | |

FOREIGN PATENT DOCUMENTS

| | | |
|---|---|---|
| EP | 1350872 | 10/2003 |
| EP | 1645201 | 4/2006 |
| EP | 1650335 | 4/2006 |
| JP | 58120834 | 7/1983 |
| WO | 20110144829 | 11/2001 |
| WO | 2004027137 | 4/2004 |
| WO | 2006000348 | 1/2006 |

OTHER PUBLICATIONS

Okamoto, M. and Kajiwara, K., "Shingosen: Past, Present, and Future," The Textile Institute, Latimer Trend, UK, Textile Progress, vol. 27, No. 2, first published in 1997, 37 pp.
X-Static Fiber YarN, Mar. 24, 2007, http:///www.ftc.com/tw/prod_cotton03e.htm.
USPTO Non Final Office Action in Ex Parte Reexamination for U.S. Pat. No. 8,440,119, dated Jul. 11, 2014, 39 pp.
Berkowitch, John E., "State of the Art Products" chapter in publication "Trends in Japanese Textile Technology," Office Technology Policy of the United States Department of Commerce, Dec. 1996, 38 pp.
Statement regarding common ownership of patent documents describing relevant technology, Apr. 27, 2015, 1 pp.
Coolmax(R) fabric Brand Value, marketing pages from website coolmax.invista.com, date unknown, 4 pp.
CoolPass(R) product disclosure, Jiangsu Hengli Chemical Fiber Co., Ltd., in English and Chinese, date unknown, 2 pp.
X-Static Fiber Yarn product disclosure, informational materials from website ftc.com.tw, date unknown, 2 pp.
Japan's polyester fiber: Shift to niche markets to avoid competition with China, Asian Textile Business, May 2003, 2 pp.
Clarke, Diana, The Sun and Your Skin, Health and Science Information on Life and Light, Interview with Kathryn Hatch, Ph.D on How Consumers can Select and care for Their Own Garments to Improve Their Sun Protection, from website www.yourskinandsun.com, Jun. 23, 2007, 4 pp.
Day, Marla, UPF Fashion! New Options to Keep UV Rays at Bay, Kansas State University Agricultural Experiment Station and Cooperative Extension Service, Aug. 2001, 4 pp.
Coolweave Pty, Activating Silver Eagle Cool Products, Aug. 29, 2007, 3 pp.
International Search Report and Written Opinion for PCT application No. PCT/US08/87155 describing related technology, dated Mar. 26, 2009, 8 pp.
Chinese Search Report and First Office Action from corresponding patent application No. 201380065828.9, translated into English, dated Mar. 8, 2016, 10 pages.
Supplementary European Search Report from corresponding patent application No. EP13846584, dated Sep. 25, 2015, 7 pages.
Transmittal regarding foreign literature, dated Jun. 21, 2017, 1 page.
Australian Examination Report from corresponding patent application No. 2013331379, dated Jun. 1, 2017, 4 pages.

* cited by examiner
† cited by third party

FABRIC AND METHOD OF MAKING THE SAME

CROSS REFERENCE TO RELATED APPLICATION

This application is a continuation-in-part, and claims the priority benefit of, U.S. nonprovisional patent application Ser. No. 12/334,682, filed Dec. 15, 2008, entitled FABRIC AND METHOD OF MAKING THE SAME, which is a nonprovisional of U.S. provisional patent application Ser. No. 61/014,973, filed Dec. 19, 2007, entitled FABRIC AND METHOD OF MAKING THE SAME. Both applications are owned by a common assignee. The entire contents of the priority applications are incorporated herein by reference.

BACKGROUND OF THE INVENTION

1. Field of the Invention

The present invention relates to a fabric and a method of making the fabric. More specifically, the present invention relates to a fabric that is made to regulate moisture dispersal therethrough to enhance its ability to provide evaporative cooling or retained cooling. Even more specifically, the present invention relates to a fabric that becomes cool when activated by liquid and remains cool for an extended period of time thereafter, and a method of making the same fabric.

2. Description of the Prior Art

Although everyone enjoys a warm sunny day, there are times when the outside temperature is too hot to be enjoyable. At such times, some people choose to remain in, or retreat to, their air-conditioned homes or offices to avoid or escape the heat. These solutions, however, are impractical to those who must remain outside, such as a highway worker, for example, and are unsatisfying to those who wish to remain outside, such as an athlete, a theme park patron or beachgoer, for example. Fabric performance will vary depending on climate, humidity, and air flow.

People have adopted a variety of approaches for cooling themselves outdoors. These efforts are largely ineffective and are not completely satisfying. For example, many people who are exposed to oppressive heat cool themselves by soaking one of the many existing fabric materials, such as a cotton facecloth or a towel, for example, in cold water and holding it against their skin. While this technique is effective, it is effective only for a very short period of time, perhaps one minute or so. The downfall of this technique is that the individual's body heat and the ambient temperature rapidly warm the initially cold water to the point that the water is no longer cooling against the skin. The most commonly employed "solution" to this problem, which is to repeatedly saturate the towel or facecloth in cold water as needed, is not satisfying because it requires much effort, and is not practical because it requires the individual to constantly be near a cold water source.

Other mechanisms employed by individuals to cool themselves include the application of ice, alcohol-dipped towels, and of relatively limited availability, cloths including phase change materials. The availability of ice in any given situation may be limited. Its formation can be costly and its ability to conform to most any area of the body is severely limited. Alcohol-dipped towels are not widely used, although they tend to be a focus of professional sports teams' cooling solutions. However, the alcohol is drying to the skin and can lead to rashes and other skin irritations. Phase change materials are chemicals that absorb and transfer heat through changes between solid and liquid state. The chemicals employed for that purpose can be hazardous and ineffective if their carriers are breached.

Presently, there is no effective non-chemical means of thermal regulating the rate of evaporation in a device that can be used to conform with a person's body, such as around the neck, for example. Evaporative cooling is the natural effect of moisture escaping into the atmosphere at will. The ability to regulate the rate of moisture dispersal and create one's personal cooling environment for an expanded period of time in a device, such as a fabric, is desirable. It is also desirable to provide an effective non-chemical means to regulate the temperature of objects, including the body, such as by providing a cooling element, for extended periods of time. Today's therapeutic wraps and compression wraps either include undesirable chemicals to generate a particular temperature condition, such as a cooling effect, they are too stiff when cooled to a low temperature, or they simply do not maintain the desired thermal condition long enough.

A need therefore exists for a convenient, easy-to-use, flexible device, such as a fabric that remains at a desired temperature for an extended period of time when held against an object, that is pliable or malleable enough to be formed to an object, such as around an arm or leg, and a method of making the fabric. A need also exists for moisture management that allows a user to establish a sustained thermal environment with minimal effort and no artificial chemicals to provide the cooling effect.

SUMMARY OF THE INVENTION

It is an object of the present invention to provide a convenient, easy-to-use, flexible fabric that remains at a desired temperature for an extended period of time when contacted against an object to be temperature regulated, such as a person's skin or an inanimate object for which temperature maintenance is desirable, and a method of making the fabric. It is also an object of the present invention to provide a moisture management fabric that can assist in maintaining a sustained thermal condition of an object for an extended period of time with minimal effort and no temperature-regulating chemicals in the fabric. Further, it is an object of the present invention to provide a method of manufacturing such a fabric with such characteristics.

The fabric of the present invention is formed by weaving or knitting a plurality of yarns together to form a plurality of zones, wherein each zone performs a particular function associated with the control of movement of liquid through the fabric. That liquid movement results in a regulation of the thermal condition of an object that the fabric contacts, including an area of the human body, for example. There are three primary types of functional zones of the fabric. The first primary functional zone type performs the function of causing a first rate of liquid movement, which rate of liquid movement is faster than the liquid movement through any of the other zone types. The first functional zone type is formed of or to include a hydrophobic material and is generally moisture resistance in that it has a characteristic of repelling water. The second primary functional zone type performs the function of causing a second rate of liquid movement, which rate of liquid movement is slower than the liquid movement through any of the other zone types. The second functional zone type is located within the interior of the fabric, it may be formed of one or more materials selected and arranged, such as by mechanical manipulation, to create a plurality of tortuous pathways through which liquid must pass before reaching another functional zone of the fabric. The pathways are established by a network of interstices or capillaries the configuration of which is defined by the fiber shape and the arrangement of fibers with respect to one another. The control of liquid movement in the fabric interior enabled by the second functional zone type allows the liquid to cool or warm as the case may be while completing passage through the fabric. The second functional zone type operates like a siphon in that it draws liquid in and moves it out of that zone. The third functional zone type of the fabric performs the function of causing a third rate of liquid movement, which rate of liquid movement is intermediate between the rates of liquid movement in the first and second functional zone types. The third functional zone type generally slows liquid movement but without the delay, and therefore substantial change in liquid temperature that the second zone type provides. The third functional zone type is formed of or to include a hydrophilic material and generally absorbs moisture more so than does the hydrophobic material and may be viewed as being an effective wicking structure in comparison to the hydrophobic material.

The composition of specific embodiments of the fabric may be varied in that each may be formed of one or more materials having characteristics that determine the characteristics of each functional zone type. The functional zone types may be combined in any selectable way dependent on the overall characteristics of the fabric desired. Each functional zone may be embodied in a specific physical layer of the fabric or some or all functional zones may be established in fewer physical layers, including just a single physical layer, of the fabric. The hydrophobic material may be polyester, the intermediate portion of the fabric may include a hollow fiber material, and the hydrophilic material may be nylon or nylon combined with polyester to form a homogeneous blend. Other materials used to make the yarns of the fabric may be employed. When the intermediate portion includes a hollow fiber, such as a hollow polyester fiber, the liquid is wicked within the conduit established by each individual fiber to facilitate transport to or from other functional zones of the fabric while also providing the capability to store the liquid within that intermediate portion. Supplemental materials may be incorporated into the fabric for supplemental purposes. For example, anti-static, anti-microbial and/or anti-odor additive materials may be used. One example of such an additive is a silver thread suitable for its anti-microbial functionality.

In one embodiment of the fabric comprising a single physical layer and being suitable for withdrawing moisture, such as sweat from a person or to provide cooling to a person located in a warm environment (for example but not limited thereto), includes three different functional zones. A first functional zone of the fabric to be positioned adjacent to an object to be cooled (or maintained at a defined thermal condition), referred to herein as the back side of the fabric, is of the first functional zone type selected to move moisture away from the object. The interior of the fabric is of the second functional zone type selected to retain the liquid passed to it from the back side of the fabric. A third functional zone of the fabric located on the side away from the object adjacent to the environment when the first functional zone is adjacent to the object, referred to herein as the front side of the fabric, is of the third functional zone type selected to cause the transfer of liquid out of the fabric to occur at a rate that is slower than the rate at which the liquid transfers away from the object. This embodiment of the invention provides for cooling, particularly of someone in a warm environment or involved in exercise, without the use of artificial chemicals to generate the cooling effect. Specifically, by enabling the withdrawal of liquid from the object, at what is likely to be its highest temperature at the surface of the object, storing the liquid within the fabric so that it cools down to become a more effective evaporative agent than it was when at a higher temperature, and restricting the ability of that cooled liquid to quickly evaporate from the environment-side of the fabric, ensures a substantially longer cooling capability than has been made available.

Another embodiment of the invention is effective at providing cooling or, more generally, to regulate the thermal condition of an object, such as an area of a person's body, for example, for a period of time that exceeds the thermal regulation provided by existing compression and other therapeutic wraps. That is accomplished with this second embodiment of the fabric without the use of chemicals. This embodiment of the fabric is an arrangement of four functional zones. The fabric can be moistened, placed in a cold environment, such as a freezer, and allowed to come to a cold temperature. In this embodiment, the fabric remains flexible after freezing and retains a cooling temperature for an extended period of time. A first functional zone that is the back side of the fabric arranged to be placed adjacent to the object is of the third functional zone type. The second functional zone, adjacent to the back side, is of the second functional zone type selected to retain liquid therein at a desired temperature for an extended period of time. The third functional zone, adjacent to the second functional zone, is of the third functional zone type. Those first three functional zones are arranged to retain liquid at a desired temperature therein, with limited regulated passage of liquid therefrom, and may be established in a single physical layer. The fourth functional zone that is the front side of the fabric when the back side is adjacent to the object, is of the first functional zone type selected to minimize moisture entry into the interior of this embodiment of the fabric and to minimize liquid evaporation out of the interior of the fabric. The fourth functional zone may be embodied in a single physical layer joined to the other three functional zones, such as by bonding with a waterproof adhesive, for example. This second embodiment of the fabric of the present invention is different from the first embodiment in that it is intended to keep the liquid therein rather than to enable the liquid to evaporate substantially therefrom.

The second embodiment of the fabric may include as a modification of at least the fourth functional zone a plurality of perforations. The perforations are used to aid in the compressive stretch of the fabric. They allow for increased evaporation to aid in cooling when the fabric is relatively wet. The perforations allow for increased breathability of the fabric when it is relatively dry. The perforations also provide increased pliability of the fabric, particularly when it has been frozen. The number of perforations and the dimensions of the perforations are selectable, dependent on the materials of at least the fourth functional zone and the pliability of one or more of the other functional zones, the thickness of the fabric, the desired fabric flexibility under a range of temperatures and the length of time desired for the fabric to provide cooling to an underlying surface, such as the skin. This embodiment of the invention enables a user to wrap the fabric around an area of the body where cooling is desired and maintain cooling compression in that area. This cooling compression configuration may also include an anchoring component to enable retention of the fabric around an area of the body such as an arm or leg but not limited thereto.

After the fabric is formed by weaving or knitting, the fabric optionally may undergo one or more treatments, such as scouring and bleaching treatments, for example. These treatments may be performed, for example, for the purpose of preparing the fabric for dyeing and/or for printing one or more designs onto the fabric. After undergoing any optional treatments, including scouring, bleaching, dyeing and/or printing, for example, in some embodiments of the invention, the fabric is brushed or peached to break some of the yarns and may be sheared to adjust the pile height of the yarns to a selectable value. For purposes of the description of some versions of the present invention, the process of making the fabric will be described as including the step of peaching, which word will be used to refer to brushing or peaching as understood by those of ordinary skill in the art. The fabric in some versions may be mechanically modified, such as by peaching but not limited thereto, in a manner that results in fibers on the front side of the fabric being pulled toward the back of the fabric. This is achieved, for example, by peaching the fabric on its back side prior to performing any peaching on its front side.

The peaching step of the manufacturing method of the present invention involves peaching both the front and back sides of the fabric multiple times each to create a homogeneous blend of different materials. That is, at least portions of the fiber material of the front side and the fiber material of the back side become entangled with one another. The use of homogeneous blends of materials having dissimilar characteristics maintain an atmosphere that is conducive to maximizing the uniqueness of the individual fiber properties and thus control/regulate the rate of liquid transport, storage and evaporation dependent on the particular functional zone type.

The present invention is directed to creating in a fabric a controlled environment that retains liquid molecules within the fabric structure. The invention utilizes yarns/fibers organized in the manner described herein to maximize fabric traits that interfere with the normal process of evaporation. As used herein, "evaporation" means the change of a liquid into a vapor at a temperature below the boiling point of that liquid; a condition that exists at the surface of the liquid, where molecules with the highest kinetic energy are able to escape. When this happens, the average kinetic energy of the liquid is lowered, and its temperature decreases. With that in mind, the present invention is configured to facilitate evaporation where desired, generate cooling through the liquid, or at least reduce the warming of that liquid, and to slow evaporation of liquid where desired. Fiber characteristics, density and arrangement all have a hand in regulating evaporation and liquid cooling rates. The present invention involves fiber selection, positioning and physical modification to achieve desired evaporation and temperature control.

When in its finished form, the fabric of the present invention may be used for any one or more of a large variety of purposes and to partially or wholly form any one or more of a large variety of products, including, but not limited to, clothing, accessories and therapeutic products. It is to be understood that the functional zones may be combined in a variety of ways and in differing numbers for particular fabric functionality purposes. For example, in addition to the two embodiments described, the fabric may be formed by two of the first functional zone type spaced from one another by the second functional zone type. Also, the fabric may be formed by two of the third functional zone type spaced from one another by the second functional zone type. Those of skill in the art will recognize that other combinations are possible. Further, as noted, the functional zones may be embodied in one or more physical layers.

The cooling properties of the fabric of the present invention, which may include maintaining an object at a selected temperature for a period of time, makes it amenable to being used in a large variety of applications. For example, the fabric may be used to wholly or partially form a plurality of apparel and personal products that can be worn or otherwise used by a person in the hot sun or while exercising to keep cool. As another example, the fabric may be used to wholly or partially form a plurality of skin-associated medical health products that can be used to keep a patient cool or otherwise temperature regulated.

These and other features and advantages of the invention will be apparent upon review of the following detailed description, the accompanying drawings and the appended claims.

DETAILED DESCRIPTION OF EMBODIMENTS OF THE INVENTION

Figure 1:
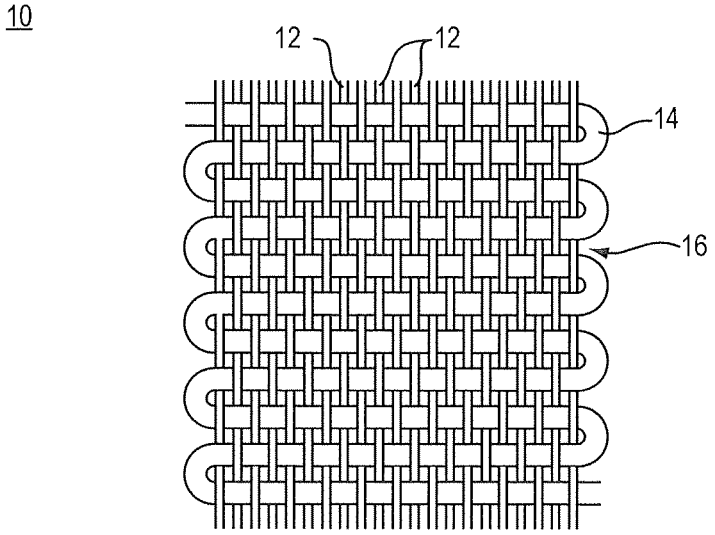
FIG. 1 is a close-up view of a fabric of the present invention showing a general form of the fabric as including a plurality of warp yarns and a single weft yarn.

The present invention is a fabric that may be single-ply or multi-ply. In a first embodiment of the invention, the fabric: (1) cools when exposed to a liquid, such as perspiration from an individual's body, for example, and/or to cool a surface, such as an area of the body, for example; (2) is able to wick (transport) perspiration, water or other liquid from an object such as an individual's skin; (3) is able to absorb a liquid at a weight that is a plurality of the weight of the fabric; (4) efficiently regulates the evaporation rate and retains a liquid with minimal loss of the liquid over an extended period of time while also enabling extended cooling of an underlying surface such as the skin of a person; (5) controls moisture release, that is, it provides moisture management; and (6) is reusable, while retaining all of these characteristics from use-to-use. The present invention also is a method of making the fabric having these characteristics.

The side of the of the first embodiment of the fabric to be positioned adjacent to the object to be cooled, referred to herein as the back side, is configured to enhance the transfer of liquid away from the object, such as by wicking, while the other side of the fabric that is spaced away from the object is configured to slow evaporation The back side may be relatively more porous than the front side as a mechanism to facilitate liquid transfer. Further, its wicking characteristics may be optimized, such as by using fibers made of hydrophobic material and/or with large peripheral surface area. That is, the back side provides a first functional zone type as previously described herein. On the other hand, the front side may be relatively less porous than the back side as a mechanism to slow liquid evaporation (by trapping the liquid, or at least slowing its progression to the outer surface of the fabric). Further, its wicking characteristics may be minimized, such as by using fibers made of absorptive or at least relatively hydrophilic material and/or with reduced peripheral surface area. That is, the front side provides a third functional zone type as previously described herein. An intermediate section of the fabric is configured to store liquid therein to allow liquid arriving from the back side to cool and slowing its passage out of the fabric through the front side. That is, the intermediate section provides a second functional zone type as previously described herein.

The selected materials and material configurations for the back side and the front side spaced by the intermediate section act in concert to enhance the movement/transportation of liquid from the surface of the object to the core of the fabric's construction. Cooled liquid either moves back toward the object or dwells long enough within the fabric to establish a sufficient heat gradient to effectively draw heat away from the object surface. This results in moisture movement in a controlled manner that enhances and extends the ability of the fabric to transfer heat between the object and the interior of the fabric. In effect, warm liquid adjacent to the surface of the object is drawn away from the object surface at the back side of the fabric and moved to the front side, while cooled liquid within the fabric is sufficiently close to the object at the back side to effect cooling. The regulated slower evaporation of the liquid from the fabric at the front side provides the extension of time for the cooled liquid within the fabric to act as a heat sink for the object.

While some manner of making a fabric creates interstices that act as fluid pathways, the combination of the material selection and mechanical manipulation of the fabric, such as by peaching but not limited thereto, makes that pathway characteristic much more substantial, creating a capillary web system that stores and orients the moisture molecules and holds them in suspension until such time as the fabric is activated; thus setting the molecules in motion and causing a disorientation of the moisture molecules so that they are inclined to move toward or away from an object to be cooled or maintained at a temperature. This recycling of moisture to and from the fabric core creates a regulated, controlled, extended evaporative cooling device.

As shown in FIG. 1, the first embodiment of a fabric 10 of the present invention, which is shown in single-ply form, includes a plurality of warp yarns 12 through which at least one weft yarn 14 is woven or knitted. It is to be understood that the weft yarn 14 may be a single, integral yarn or it may be a plurality of yarns. When the weft yarn 14 is a plurality of yarns, the plurality of yarns may be fastened together, such as by tying, for example, or they may be separately woven or knitted through the warps yarns 12. When formed by the warp and weft yarns 12/14, the fabric 10 has a front side 16 and a back side 17 (shown in FIG. 9), which is opposite the front side 16.

The warp and weft yarns 12/14 include a plurality of fibers. (Hereinafter, whenever the term "yarn" is not referred to specifically as either a "warp yarn" or a "weft yarn", it is to be understood that "yarn" is to include both a "warp yarn" and a "weft yarn".) The fibers of the yarns 12/14 may be formed from any one or more of a variety of materials including, but not limited to, polyester, and nylon, for example, with the nylon at the front side 16 and the polyester at the back side. The product CoolMax®available from E.I. DuPont de Nemours and Company of Wilmington, Del., or the product CoolPass® available from Jiangsu Hengli of Jiangsu, China, may be suitable choices for the polyester material of the back side. Any nylon is suitable for the front side 16 material and may be obtained from a wide range of sources, as is know by those of ordinary skill in the art. Additionally, the fabric 10 may include a hollow polyester fiber as an intermediate material to enhance fluid transport through the fabric 10 and storage of liquid within the fabric 10 for a period of time sufficient to allow evaporative cooling of the liquid while the front side 16 material reduces evaporative loss of the liquid. Further, additive materials may be incorporated into the fabrication of the fabric 10. Such additives may be selected for the purpose of eliminating odor, microbe formation or existence, static or other undesirable characteristics. One example of such an additive is a silver fiber suitable for anti-microbial protection. The silver-coated fiber X-Static® available from Noble Materials of Scranton, Pa., is an example of a suitable silver fiber additive.

In one version of the first embodiment of the present invention, the fabric 10 may be about 65% to about 85% polyester and about 15% to about 35% nylon. In another embodiment, the fabric 10 may be about 80% polyester and about 20% nylon. In yet another embodiment, the fabric 10 may be about 77% polyester and about 23% nylon. The actual fiber type choice and their percentage of use are dependent on the desired function of the fabric 10.

The relative thickness and fiber count of the yarns 12/14 is variable. Exemplary warp yarns 12 include warp yarns 12 ranging between about 50 denier and about 100 denier. For example, the warp yarn 12 may be about 75 denier. (The finer the denier, the greater the ability to create loft or pockets in which moisture can be held.) It is to be understood, however, that the weft yarn 12 is not limited to having these characteristics.

Exemplary weft yarns 14 include weft yarns 14 ranging between about 125 and about 175 denier and having a fiber count ranging between about 50 to about 175. For example, the weft yarn 14 may be about 160 denier and have a fiber count of about 70 or about 72. As another example, the weft yarn 14 may be about 160 denier and have a fiber count of about 144. It is to be understood, however, that the warp yarn 14 is not limited to having these characteristics.

Further, the yarns 12/14 may be of any one of a variety of textures and luster. For example, the yarns 12/14 may be, but are not limited to being, draw textured yarn (DTY), bright, semi-bright and semi-dull hollow (SDH).

Figure 2:
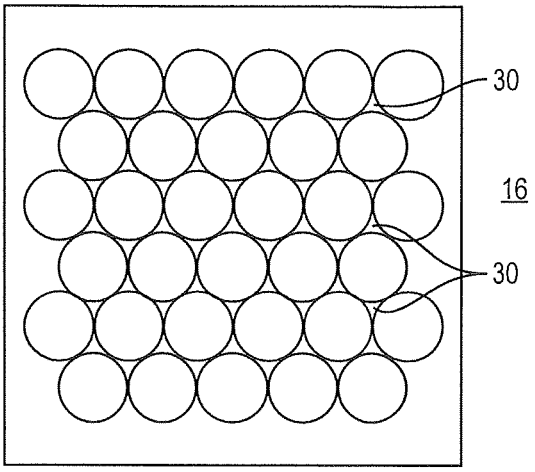
FIG. 2 is a cross sectional plan view of a simplified representation of the front side of the fabric.
Figure 3:
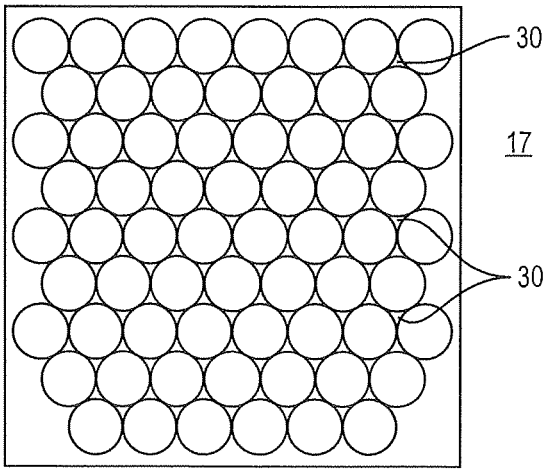
FIG. 3 is a cross sectional plan view of a simplified representation of the back side of the fabric.

As illustrated in FIG. 2, the fibers used to form the front side 16 of the fabric 10 are preferably relatively larger than the fibers used to form the back side 17 of the fabric 10 shown in FIG. 3. Specifically, the larger fibers of the front side 16 have fewer interstices 30 through which liquid can escape from within the interior of the fabric 10. On the other hand, the smaller fibers of the back side 17 have more interstices 31 through which liquid may pass relatively more quickly than is the possibility with the relatively smaller number of interstices of the front side 16. In addition, the smaller denier of the fibers of the back side 17 have more perimeter surface area for wicking to occur. Further, using a hydrophobic material on the back side 17 is more likely to repel liquid and therefore speeds liquid wicking into the interior of the fabric 10, while using a hydrophilic material on the front side 16 is more likely to absorb liquid and therefore slows liquid wicking through and out of the fabric 10. It is to be understood that either side of the fabric 10 may include a single fiber size or a plurality of fiber sizes. For example, varied thermal control may be established for the fabric 10 from one portion thereof to another by selecting different fiber materials and/or fiber sizes for the front side 16 and the back side 17.

Figure 4:
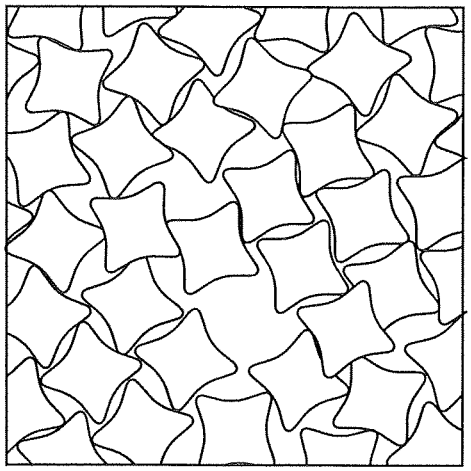
FIG. 4 is a cross sectional elevation view of a plurality of fiber materials having increased surface area for enhanced wicking.

Liquid wicking may be further enhanced by increasing the perimeter surface area of those fibers where enhanced wicking is desired. For example, the fibers of the back side 17, in addition to being smaller than the fibers of the front side 16, and/or hydrophilic rather than hydrophobic, may be shaped fibers having non-uniform cross sectional area. For example, FIG. 4 illustrates a fiber shape that is not uniformly round. The perimeter surface area of each such fiber is greater than the corresponding fiber of uniform shape and similar cross sectional area. An embodiment of the present invention includes making the back side 17 of the fabric 10 with such non-uniform fibers.

Figure 5:
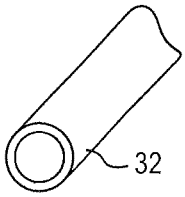
FIG. 5 is a cross sectional view of a first embodiment of a hollow fiber material for enhanced liquid transport and storage.
Figure 6:
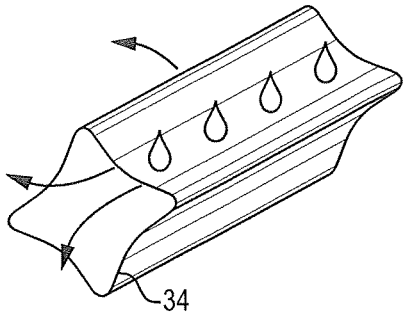
FIG. 6 is a cross sectional view of a second embodiment of a hollow fiber material for enhanced liquid wicking, transport and storage.

The fabric 10 of the present invention may also a material that is configured to maximize liquid transport and storage for the second functional zone type. As illustrated in FIG. 5, a first embodiment of a hollow fiber 32 may be employed as an intermediate material of the second functional zone type at the intermediate section of the fabric 10, wherein one or more such fibers are positioned between the front side 16 and the back side 17 of the fabric 10. The hollow fiber 32 is shown having a uniform cross sectional area. It is preferably made of a hydrophilic material so that it slows wicking, at least relative to a hydrophobic material. The interior of the hollow fiber 32 acts as a container for liquid passing therein. In an alternative embodiment of FIG. 6, second hollow fiber 34 is of non-uniform cross sectional area. Its increased perimeter surface area and hollow interior maximizes liquid retention within the fabric 10. This ability to allow liquid that is relatively warmer near the back side 17 to dwell within the fabric intermediate section ensures cooling of the liquid will occur to a point sufficient to permit that retained liquid to act as a heat sink as it approaches the front side 16 of the fabric 10. The second hollow fiber 34 is preferably made of a hydrophilic material so that it slows wicking, at least relative to a hydrophobic material.

Figure 7:
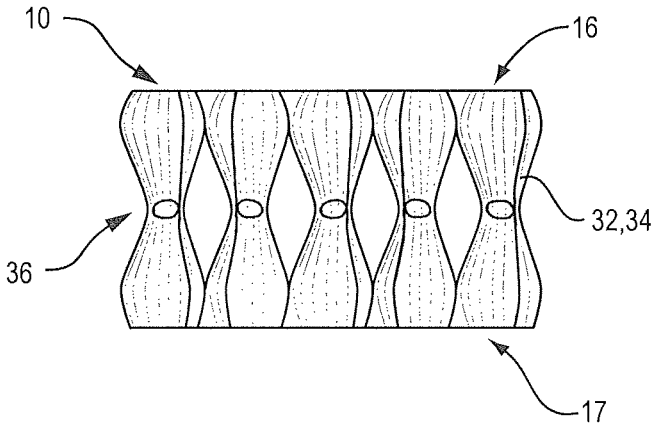
FIG. 7 is a cross sectional view elevation view of an embodiment of the fabric of the present invention, showing an intermediary fiber material between the back side and front side of the fabric.
Figure 9:
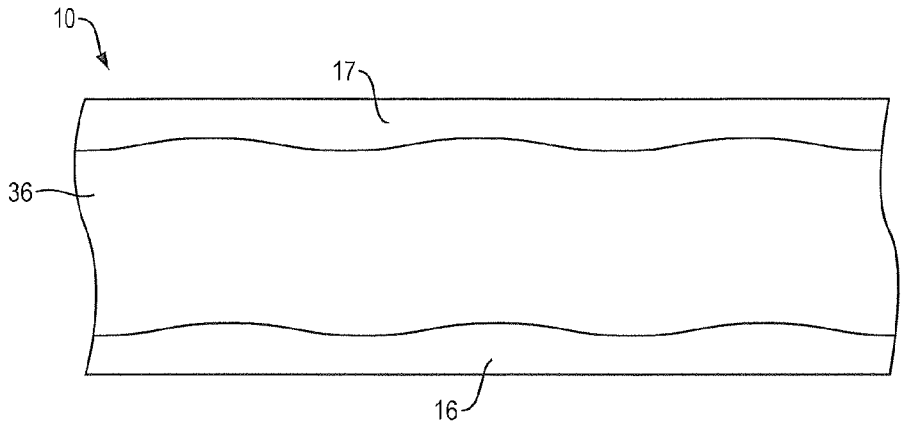
FIG. 9 is a cross sectional view of an embodiment of the fabric of the present invention with three functional zones.
Figure 10:
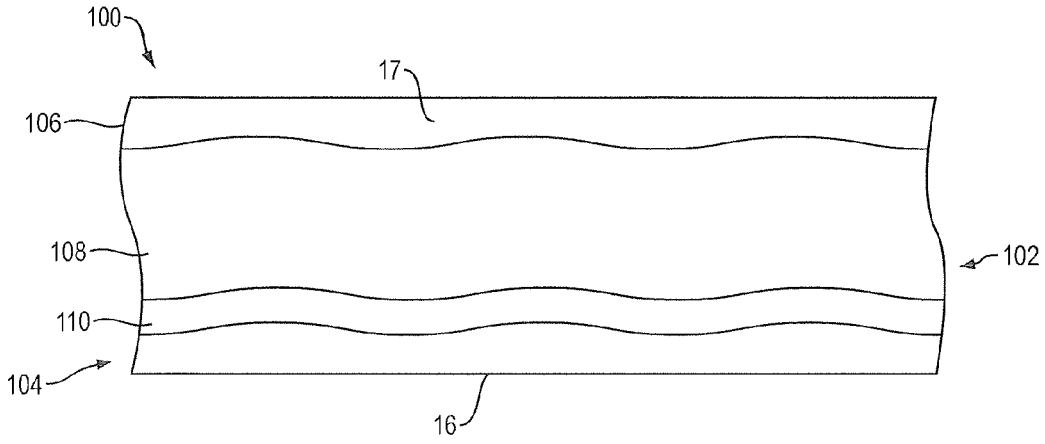
FIG. 10 is a cross sectional view of an embodiment of the fabric of the present invention with four functional zones.

As illustrated in FIG. 7, a plurality of intermediate section materials, such as a plurality of the hollow fiber 32 and/or the second hollow fiber 34, may be used with the fiber materials of the front side 16 and the back side 17 to form the second functional zone of the fabric. The combination of components identified enable the fabric 10 to speed at the back side 17 liquid wicking from the surface of the object, allow that liquid to dwell within the fabric intermediate section 36, and cause its evaporation completely from the fabric 10 to be delayed at the front side 16. The fabric 10 thereby includes the three functional zones types previously described and as shown in FIG. 9, wherein the back side 17 is of the first functional zone type, the intermediate section 36 is of the second functional zone type and the front side 16 is of the third functional zone type.

Figure 8:
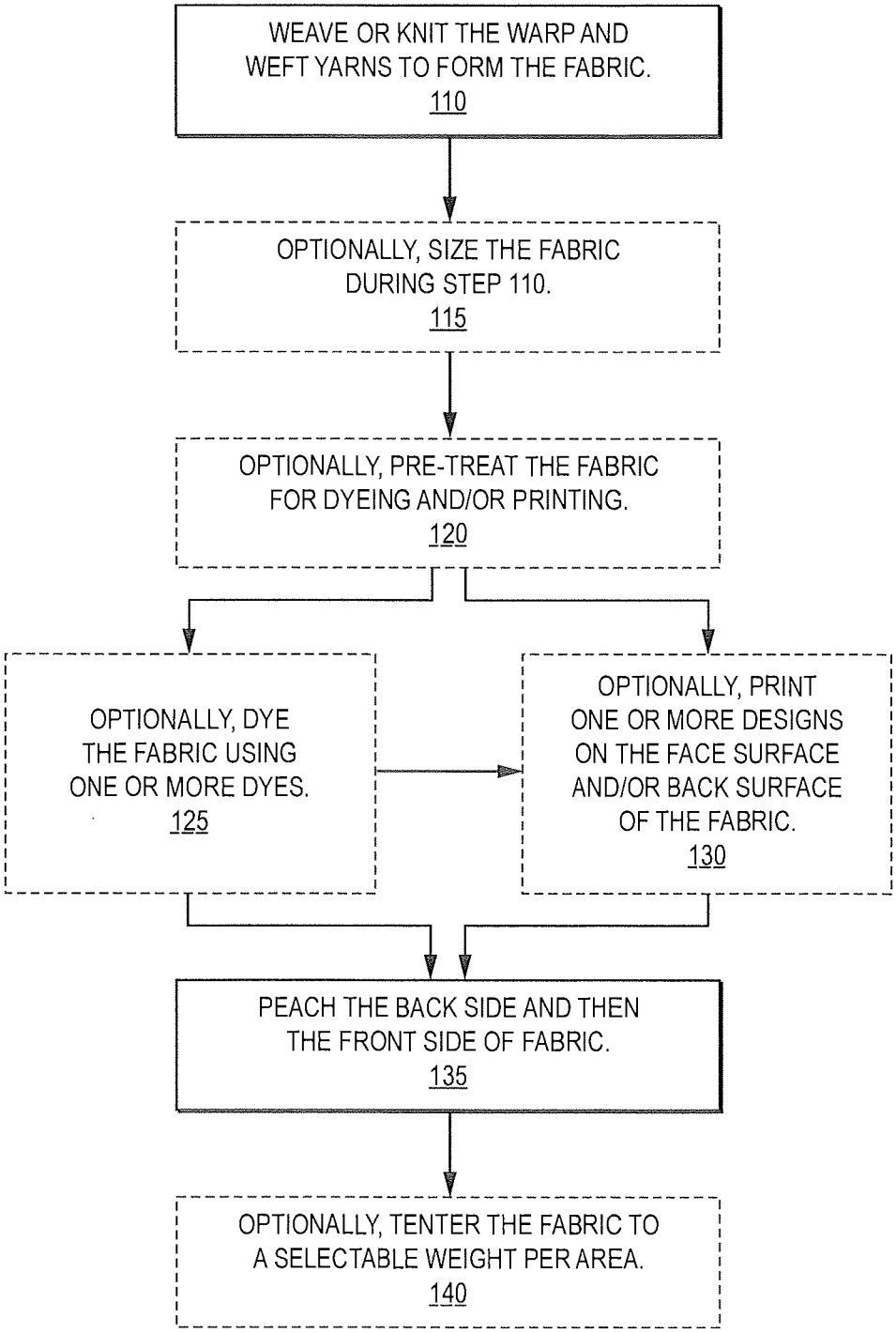
FIG. 8 is a flow diagram showing the general steps, some of which are optional, that may be taken to carry out a method of the present invention.

A fabrication method of the present invention suitable for forming the fabric 10 of the first embodiment of the invention includes a plurality of steps, several of which are optional, in the fabrication of the first embodiment of the fabric. Generally, the steps of the method 100 may be carried out as shown in FIG. 8. In step 110, the fabric 10 is formed by weaving or knitting the yarns 12/14 together. For purposes of the description of the present invention, the two terms may be used interchangeably, such that when it is stated that the method 100 includes a weaving step, that means weaving or knitting the yarns together. In optional step 115, the fabric 10 may be sized simultaneously with the step 110. In optional step 120, the fabric 10 may be pre-treated as described herein to prepare it for subsequent dyeing and/or printing, for example, or for any other purpose. In optional step 125, the fabric 10 may be dyed any color using any one dye or combination of dyes. In optional step 130, one or more designs may be printed onto either or both of the face side 16 and the back side of the fabric 10. Because each one of steps 125 and 130 are optional, the fabric 10 therefore may be dyed but not printed, printed but not dyed, both dyed and printed, or neither dyed nor printed. In step 135, the fabric 10 is peached and sheared, and in optional step 140, the fabric 10 is tentered until the fabric 10 has a desirable weight per area value. (The weight per area of the fabric 10 therefore is selectable.)

The skilled artisan will recognize that the yarns 12/14 may be woven or knitted to form the fabric 10 by using any one or more of a variety of techniques that are well known in the art. For example, the skilled artisan will recognize that such weaving may be carried by using an air jet frame, and that such knitting may be carried out by using a 28-gauge double loop circular frame. Certainly not restricted or limited to these exact type of machines. Extensive research and development would be required to duplicate the physical construction to produce the same results on varied equipment but can be accomplished.

The fabric 10 optionally may be sized, such as for the purpose of increasing the strength of the yarns, for example. Sizing may be carried out, for example, by adding one or more sizing agents, preferably water-soluble sizing agents, during the weaving/knitting process.

The fabric 10 also is optionally dyeable and/or printable (that is, one or more designs may be printed onto the fabric 10). When the fabric 10 is to be dyed and/or printed, the fabric 10 may be pre-treated before the dyeing and/or printing of the fabric 10. For example, prior to dyeing and/or printing, the fabric 10 optionally may be subjected to one or more treatments, such as scouring and bleaching treatments, for example. Further, when the fabric 10 has been sized, the fabric 10 may be desized at this time. Desizing may be carried out, for example, simply by immersing the fabric in hot water.

Scouring may be carried out for the purpose of removing impurities, such as wax, oil, and dirt, for example, from the fabric 10. Scouring may be achieved by treating the fabric 10 with a scouring agent while the fabric 10 is being subjected to pressure and heat, the temperature of which is selected based upon the fibers selected to make the fabric. For example, if no hollow fibers are employed, or if fiber hollowness is not of sufficient importance, the heating may be at about 350° F., for example. The scouring agent may be a sodium hydroxide solution, for example. Further, the scouring agent may be a commercially available polymeric soil release agent, such as any one of the products of the Zelcon® line of products made available by E.I. DuPont de Nemours and Company of Wilmington, Del., and Milease T, which is made available by Imperial Chemical Industries, PLC of London, England, for example.

The fabric 10 also may be optionally bleached for the purpose of whitening the fabric 10. Generally, bleaching may be carried out, for example, by treating the fabric 10 with a bleaching agent, incubating the fabric 10 at an elevated temperature for an extended period of time, and washing and drying the fabric 10. Suitable bleaching agents include, but are not limited to being, solutions containing sodium hypochlorite, sodium chlorite and/or hydrogen peroxide, for example. Where the chosen bleaching agent is an alkaline solution, such as a hydrogen peroxide solution, for example, the bleaching may be carried out concomitantly with the scouring treatment.

It is to be understood that the fabric 10 may be pre-treated, such as being desized, scoured, or bleached, even when the fabric 10 is not to be later dyed and/or printed. For example, the fabric 10 may be bleached, but not dyed and/or printed, when the fabric 10 is to be white in its final form. As another example, the fabric 10 may be scoured, but not dyed or printed, when the fabric 10 is to retain its natural color in its final form.

After the fabric 10 has been pre-treated, if at all, dyeing of the fabric 10 may be achieved, for example, by using one or more disperse dyes of any color or combinations of color in a pressure and continuous dyeing process. Dyeing by using disperse dyes may include subjecting the fabric 10 to the dye or dyes while the fabric 10 is being exposed to elevated heat and high pressure, again, dependent upon the materials used to make the fabric 10. Under such conditions, the dye or dyes are able to penetrate the yarns 12/14 of the fabric 10, effectively dyeing the fabric 10.

Further, after the fabric 10 has been pre-treated and/or dyed, if at all, one or more designs optionally may be printed onto the fabric 10. It may be desirable to print a design or designs on the fabric 10 for a variety of reasons. For example, when a theme park is to distribute a product including the fabric 10, the theme park may wish to have a cartoon character or its logo printed onto the fabric 10 to help promote its brand. In this example, it is likely that the printed design would be fanciful and include a plurality of colors. As another example, when a hospital is to own a medical product that includes the fabric 10, the hospital may wish to its name printed onto the product for the purpose of helping to prevent the product from being removed from the hospital. In this example, it may be true that the printed design would be simple and include only a single color (e.g., the hospital's name may appear in black letters of a standard font).

Therefore, designs may be printed onto the fabric 10 by using one or more dyes or pigments. Further, the designs may be printed onto to the fabric 10 by using various methods and devices known to the skilled artisan. For example, the printing may be achieved by rotary screen printing, wherein the fabric 10 passes under a series of cylindrical screens, with each screen printing a different color onto the fabric 10.

Regardless of whether the fabric 10 is dyed and/or printed, the fabric 10 is mechanically manipulated, such as by peaching but not limited thereto, and may then be sheared. Prior to manipulation, moisture may be extracted from the fabric 10 by any one of a variety of techniques that are well known to the skilled artisan. This extraction may be achieved, for example, by centrifugation. The fabric 10 also may be dried by using a continuous hot oil drum, for example. Alternatively, the fabric 10 need not be peached as described herein. Instead, the fibers may be machined in a manner that causes them to become entangled, thereby increasing the tortuousness of the path of liquid moving within the fabric 10.

The skilled artisan will recognize that if peaching is done, it may be achieved by carrying out any one or more of a variety of techniques and by using any one or more of a variety of devices. For example, peaching may be achieved by using a sanding machine that includes a series of circular pads that rotate in different directions to break the yarn 12/14 fibers. Further, as an alternative to this peaching process, the fabric 10 may be brushed by using a series of tubes having wire bristles that rotate in a circular motion around a circular cylinder. In this arrangement, the bristles contact the fabric front side 16 and/or the fabric back side 17, thereby breaking some fibers in doing so. The fabric back side 17 is peached before the front side 16 is peached, and some of the yarns of the front side 16 are pulled through to the fabric back side 17 as a result of the peaching process to form a homogeneous blend of the different fiber materials. The final weight of the fabric is ultimately determined by creating the correct face to back pile ratio.

The skilled artisan will further recognize that shearing may be achieved by carrying out any one or more of a variety of techniques using any one or more of a variety of devices. Shearing may be achieved, for example, by using a machine that features a single cylinder rotation over a honed blade. In this arrangement, the blade is able to cut the previously peached front side 16 and/or back to a desired pile height. The pile height of the front side 16 or back side 17 may be selected, for example, to maximize or otherwise determine the moisture absorption ability of the fabric 10 by creating pile density or volume. While very specific exemplary pile heights are described in the Example section included herein, it is to be understood that the present invention is not limited to those values. In fact, the skilled artisan will recognize that a large plurality of pile height values is achievable.

The fabric 10 also may be tentered, such as to adjust the weight per area of the fabric 10 to a particular, selectable value, for example, by using any one or more of the tentering techniques that are well known to the skilled artisan. In one exemplary tentering technique, the fabric 10 is applied to a machine having a tenter frame of open width. (The "tenter frame" is a set of rails that run parallel to the floor on which the machine sets.) Located on these rails are sets of needles that grip the fabric 10 to hold it in place on the machine. The width of the frame may be varied as the fabric 10 moves through the machine, and when the fabric 10 reaches the desired width, live steam is injected into the fabric 10 to create memory in the fabric. ("Memory" is the phenomenon by which the fabric returns to its machined size whenever it is stretched, such as by human hand, for example.) While very specific exemplary weight per area values of the fabric 10 are described herein, it is to be understood that the present invention is not limited to those values. In fact, the skilled artisan will recognize that a large plurality of weight per area values is achievable. Final printing may then be performed on the fabric 10.

The skilled artisan will recognize that the fabric 10 of the present invention may be used for any one or more of a large variety of purposes and to partially or wholly form any one or more of a large variety of products. For example, the fabric 10 may be used to partially or wholly form apparel or non-apparel products such as towels, facecloths, shirts, pants, jackets, shorts, vests, ties, footwear, gloves, bandanas, hats, handkerchiefs, underwear, hosiery, bras, and bandages. Further, these products may be designed for recreational, exercise, medical, and military use, for example. For example, the fabric 10 may be used to form a towel that is to be sold or otherwise distributed to individuals who will be exposed to hot temperatures for a long period of time, such as patrons of an outdoor theme park, beachgoers, or athletes, for example. As another example, the fabric 10 may wholly or partially form a compress that may be wetted and placed on the forehead of an individual having an elevated body temperature for the purpose of keeping the individual cool. Regardless of how and for what reason the fabric 10 is to be used, however, the fabric 10 is especially useful for being included to wholly or partially form a product that is meant to provide instant and extended cooling to its user.

Once manufactured, the fabric 10 may be used by performing the following steps. The fabric 10 is initialed immersed in a liquid, such as water and soaking the fabric in the liquid. The liquid may be at any of a variety of temperatures for the immersion step. Next, any excess liquid on the surface of the fabric 10 or located within its interstices, may be wrung out, such as by twisting the fabric 10 (which is flexible), to force the excess liquid from the fabric 10. Next, the wrung out fabric 10 may be "snapped" to trigger activation of the thermal control capability of the fabric 10. For the purpose of the description of the present invention, snapping means any mechanical procedure by which the wetted fabric 10 is quickly moved from one position to another. For example, a person may snap the fabric 10 by holding it in two hands at its perimeter and rapidly moving upward and downward in one or more cycles. Alternatively, the snapping may be achieved by other means, such as with a mechanical device, for example.

The formation of the fabric 10 with a combination of the plurality of materials described herein configured in relation to one another as indicated results in the creation of a plurality of high-density capillary networks within the fabric 10. Liquid molecules are absorbed deep into the core of the fabric 10 and hydraulically compressed into the capillary networks of the fabric 10, such as through the activation process described above. The water molecules are oriented within the capillary networks by the activation step to enable maximum evaporative cooling to occur through the fabric 10. Additionally, the configuration of the fabric materials through the manipulation process, as well as the characteristics of the materials, suppresses the otherwise natural occurrence of evaporative liquid loss that can occur with conventional fabric structures. In effect, the fabric 10 of the present invention traps the liquid into a cycle of evaporative cooling adjacent to the object to be cooled, trapping of evaporative liquid moving away from the object into the fabric interstices until, as the evaporated liquid approaches the opposing hydrophilic side of the fabric, it cools and returns to the object. This repetitive cooling cycle is achieved by the construction of the fabric 10 and allows the user to use water as the liquid employed for the evaporative cooling. The fabric 10 thereby eliminates the need to use chemicals such as alcohol and/or PCMs as an artificial cooling agent.

The fabric 10 and the method of the present invention are more specifically described with reference to the Example; however, they are not to be construed as being limited thereto. The fabric 10 of this Example exhibited cooling characteristics while maintaining structural integrity.

EXAMPLE

Fabric formation. A first fabric of the first embodiment of the invention having about 77% polyester and about 23% nylon was made in this Example. The warp yarn included as part of the fabric was DTY and SDH and had a relative thickness of about 75 deniers. The weft yarn included as part of the fabric was DTY and had a relative thickness of about 160 deniers per 144 fibers.

Prior to being woven, the yarns were added to an air jet weaving loom (having a width of 10,612 ends) at a density of a thread count of about 160 threads her square inch. The yarns were then woven to form the fabric according to standard protocols that are well known to those of ordinary skill in the art.

Printing pre-treatment. After being woven, the fabric was scoured by using Zelcon to remove any dirt, wax, oil, or other contaminants that may have been present.

Fabric Printing. After scouring, a plurality of multi-colored designs was printed onto the face of the fabric by using a sublimation printer according to protocols that are well known to those of ordinary skill in the art. Suitable printers for achieving such printing are available from, for example, the Roland DGA Corporation of Irvine, Calif., and Mimaki USA, Inc. of Suwanee, Ga.

After the printing process was complete, more than 90% of the moisture absorbed by the fabric was extracted from it by centrifuging the fabric for about 12 minutes. The fabric was then dried at about 400° F. while in a gas continuous hot oil drum and rolled into tubular form via an "a-frame" windup folding machine. The fabric back was peached and sheared to about 0.0939 inches (about 0.2385 cm). After the fabric back was peached, the fabric face was peached and then sheared to about 0.0313 inches (about 0.0795 cm). Specifics here are based on a desired finished weight based on a specific end use that requires a variation in weight for its intended performance level. This final weight is in direct proportion to the variation of the yarn (face/back/fill) of the yarn denier and the final finish.

Following peaching and then shearing, the fabric was tentered at about 380° F. The weight of the fabric after tentering was about 208 g/m$^2$.

A second embodiment of a fabric 100 of the present invention as a compression wrap is described with respect to FIGS. 10-13. The fabric 100 is multi-ply formed of a first fabric physical layer 102 and a second fabric physical layer 104. The first fabric layer 102 is arranged to retain liquid therein and permit some absorption and evaporation. The second fabric layer 102 is arranged to restrict evaporation and minimize moisture entry into the first fabric layer 104. The first fabric layer 102 is arranged to be placed to an object to be regulated for temperature, such as a body part to be cooled. The second fabric layer 104 is arranged to be adjacent to the environment when it is joined to the first fabric layer 102 and the fabric 100 applied to the object to be thermally conditioned.

The first fabric layer 102 of the fabric 100 includes a first functional zone 106 corresponding to the back side 17. The first functional zone 106 is of the third functional zone type described herein in that it enables the wicking and some retention of moisture from an underlying surface. The first fabric layer 102 also includes a second functional zone 108 spaced from the object when the fabric is applied to the object by the first functional zone 106. The second functional zone 108 is of the second functional zone type describe herein in that it enables the retention and storage of liquid therein and reduces the rate of transport of the liquid out of the first fabric layer 102. The first fabric layer 102 also includes a third functional zone 110 spaced from the first functional zone 106 by the second functional zone 108. The third functional zone 110 is of the third functional zone type describe herein in that it enables the retention of moisture within the second functional zone 108 while enabling some evaporation of liquid through to the second fabric layer 104. The second fabric layer is a fourth functional zone of the first functional zone type described herein in that it facilitates the evaporation of liquid out of the first fabric layer 102 while minimizing moisture entry into the first fabric layer 102 from the environment.

Whereas the fabric 10 is configured to regulate the passage of fluid through and out of the fabric 10 enough to allow warm moisture at back side 17 to cool within the fabric 10 before it is permitted to exit the front side 16, the fabric 100 substantially limits fluid passage out of the fabric 100. Instead, whereas the fabric 10 is designed to remove warm moisture, such as sweat, from an area of the body, the fabric 100 is designed to keep cooling moisture near a surface of an object, such as an area of the body for which a cooling or compression pack is desired. In particular, the fabric 100 includes fibers made partially or entirely of hydrophilic material at the first and third functional zones 106 and 110, thereby limiting the wicking of moisture out of the fabric 100. The fabric 10, on the other hand, is arranged to facilitate the wicking of moisture out of the fabric 10 and therefore substantially includes fibers of hydrophilic material at its first functional zone established at the back side 17.

The fabric 100 includes a plurality of warp yarns 12 through which at least one weft yarn 14 is woven or knitted. It is to be understood that the weft yarn 14 may be a single, integral yarn or it may be a plurality of yarns. When the weft yarn 14 is a plurality of yarns, the plurality of yarns may be fastened together, such as by tying, for example, or they may be separately woven or knitted through the warps yarns 12. The warp and weft yarns 12/14 include a plurality of fibers. The fibers of the yarns 12/14 may be formed from the materials described herein with respect to the fabric 10. The arrangement of the warp and weft yarns 12/14 may be similar to that which is shown in FIG. 1. Although shown in FIG. 1 as a relatively open weave or knit, it is to be understood that the weave or knit may be much tighter with the yarns closely interfacing with one another. The fabric 100 may include one or more hollow fiber materials, including a hollow polyester fiber of the type described herein with respect to the fabric 10, as an intermediate material to enhance fluid retention and transport within the interior of the fabric 100. Further, additive materials may be incorporated into the fabrication of the fabric 100. Such additives may be selected for the purpose of eliminating odor, microbe formation or existence, static or other undesirable characteristics. One example of such an additive is a silver fiber suitable for anti-microbial protection. The silver-coated fiber described herein.

Figure 11:
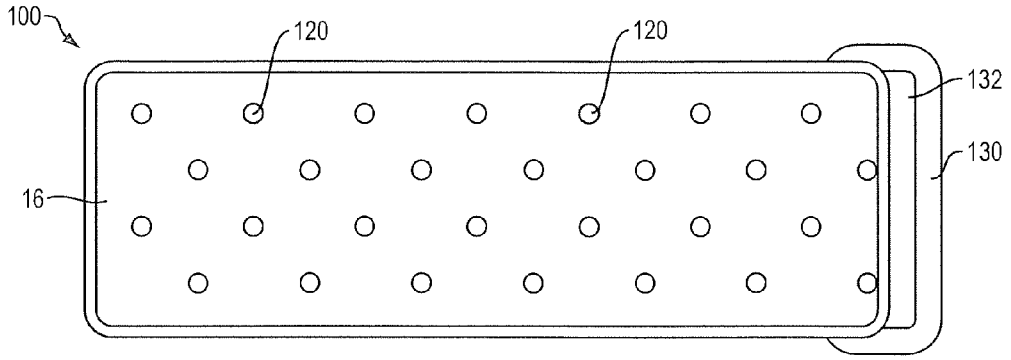
FIG. 11 is a view of the front side of a compression wrap version of the fabric of the present invention.
Figure 12:
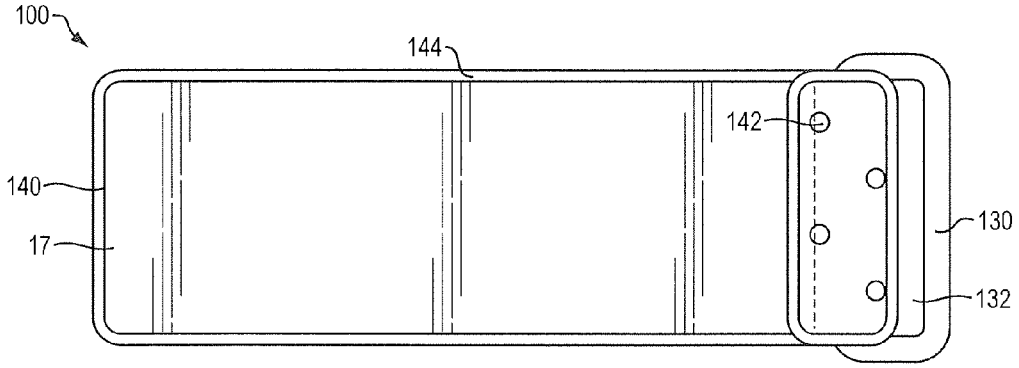
FIG. 12 is a view of the back side of the compression wrap of FIG. 11.
Figure 13:
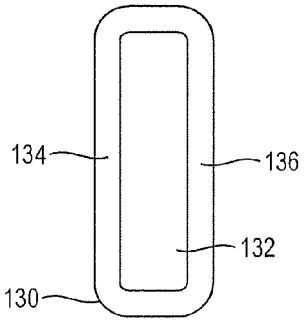
FIG. 13 is a top view of the anchor of the compression wrap of FIG. 11.

The second fabric layer 104 may be arranged as a "hook-and-loop" independent fabric structure as noted. The second fabric layer 104 may be joined to the first fabric layer 102 at third functional zone 110 by physical or chemical joining such as bonding with a water-resistant adhesive. The second fabric layer 104 may be needled punched prior to joining with the first fabric layer 102 to establish a plurality of perforations 120, as shown in FIG. 11, to enhance the flexibility of the fabric 100. The perforations 120 also provide small avenues for moisture transfer out of the fabric 100. The size and number of perforations 120 is selectable as a function of the extent of moisture transfer and flexibility desired.

In one embodiment of the present invention, the first fabric layer 102 of the fabric 100 may be about 65% to about 85% nylon fibers and about 15% to about 35% polyester fibers, with the second fabric layer 104 formed substantially of a polyester material. In another embodiment, the first fabric layer 102 may be about 80% nylon fibers and about 20% polyester fibers. In yet another embodiment, the first fabric layer 102 may be about 77% nylon fibers and about 23% polyester fibers. The actual fiber type choice and their percentage of use are dependent on the desired cooling capability and flexibility desired for the fabric 100.

The relative thickness and fiber count of the yarns 12/14 for the fabric 100 is variable. Exemplary warp yarns 12 include warp yarns 12 ranging between about 50 denier and about 100 denier. For example, the warp yarn 12 may be about 75 denier. (The finer the denier, the greater the ability to create loft or pockets in which moisture can be held.) It is to be understood, however, that the weft yarn 12 is not limited to having these characteristics. Exemplary weft yarns 14 include weft yarns 14 ranging between about 125 and about 175 denier and having a fiber count ranging between about 50 to about 175. For example, the weft yarn 14 may be about 160 denier and have a fiber count of about 70 or about 72. As another example, the weft yarn 14 may be about 160 denier and have a fiber count of about 144. It is to be understood, however, that the warp yarn 114 is not limited to having these characteristics. Further, the yarns 12/14 may be of any one of a variety of textures and luster. For example, the yarns 12/14 may be, but are not limited to being, draw textured yarn (DTY), bright, semi-bright and semi-dull hollow (SDH). The fabric 100 may be further processed as described herein with respect to the fabric 10 in regard to stretching, printing and the like.

As illustrated in FIGS. 10-13, the fabric 100 includes an optional anchor 130 that enables a user to secure the fabric 100 embodied as a compression or cooling wrap, about a part of the body such as the arm. The anchor 130 is a ring or other structure with an open interior section 132 sized sufficient to permit at least the width of the fabric 100 to pass therethrough. The anchor 130 may be translucent nylon, urethane or a stretch cord but not limited thereto. The fabric 100 as wrap having a first end 140 and a second end 142 is arranged such that the second end 142 is folded back onto a main body 144 of the fabric 100 and joined thereto with stitching, such as flatlock stitching, for example. Prior to that joining, the second end 142 is placed within the interior section 132 of the anchor 130 passed around a leg 134 thereof and then joined to the main body 144. That holds the anchor 130 to the fabric 100. A user may apply the fabric 100 to an object to be thermally managed, pass the first end 140 of the fabric through the open interior section 132 and secure it in place, either on the main body 144 with Velcro™ for example, or to a second leg 136 of the anchor 130.

The fabric 100 can be used as a compress and may be used in any of at least four ways. First, it may be applied directly to the body and used as a dry compression wrap. Second, the fabric 100 may be immersed in a liquid, such as water, and soaked to ensure that the fabric 100 substantially reaches its maximum liquid storage capacity. It may be wrung out to remove any excess liquid and then applied to the body as a cool compression wrap. Third, the fabric 100 may be immersed in a liquid, such as water, and soaked to ensure that the fabric 100 substantially reaches its maximum liquid storage capacity. It may be wrung out to remove any excess liquid. Next, the fabric 100 is inserted into a cooling container, such as a freezer, and retained therein for enough time to allow the liquid to chill but not solidify. The configuration of the fabric 100 ensures that it will remain flexible even with cold liquid retained therein. The fabric 100 may be removed from the cooling container and applied to the body as a cold compression wrap. Finally, the fabric 100 may be immersed in a liquid, such as water, and soaked to ensure that the fabric 100 substantially reaches its maximum liquid storage capacity. It may be wrung out to remove any excess liquid. Next, the fabric 100 is inserted into a cooling container, such as a freezer, and retained therein for enough time to allow the liquid to solidify. The configuration of the fabric 100 ensures that it will remain flexible even with solidified liquid retained therein. The fabric 100 may be removed from the cooling container and applied to the body as an ice-alternative compression wrap. The anchor 130 may be used to secure the fabric 100 in place in any of these usage options. The configuration of the fabric 100 ensures that warmed liquid near the surface to be cooled passes into the interior of the fabric 100 where it is cooled and cooler or still solidified liquid moves to the surface to be cooled. The use of the first fabric layer 102 and the second fabric layer 104 limits the extent of liquid passage out of the fabric 100.

The present invention has been described with respect to various examples. Nevertheless, it is to be understood that various modifications may be made without departing from the spirit and scope of the invention as described by the following claims.

What is claimed is:

1. A method of cooling an object with a fabric having a front side and a back side, wherein the front side of the fabric is the side adjacent to the environment when the fabric is in use and the back side is the side adjacent to the object when the fabric is in use, the method comprising the steps of:

a. placing the fabric in contact with a liquid, wherein the fabric includes:
   i. a first functional zone of the back side configured to absorb moisture;
   ii. a second functional zone adjacent to the first functional zone configured to restrict the passage of liquid within the fabric, wherein the second functional zone includes a plurality of fibers, wherein the plurality of fibers includes hollow fibers;
   iii. a third functional zone adjacent to the second functional zone configured to absorb moisture; and
   iv. a fourth functional zone of the front side adjacent to the third functional zone configured to resist moisture absorption;
b. removing excess liquid from the fabric;
c. chilling the fabric; and
d. applying the chilled fabric to the object.

2. The method as claimed in claim 1 further comprising the step of anchoring the fabric about the object.

3. The method as claimed in claim 1 wherein the first and third functional zones of the fabric include a plurality of fibers, wherein the plurality of fibers includes fibers formed of a hydrophilic material.

4. The method as claimed in claim 1 wherein the fourth functional zone includes a plurality of fibers, wherein the plurality of fibers includes fibers formed of a hydrophobic material.

5. The method as claimed in claim 1 wherein the hollow fibers are formed of a hydrophilic material.

6. The method as claimed in claim 1 wherein the first, second and third functional zones of the fabric are established in a first physical fabric layer and the fourth functional zone is established in a second physical fabric layer.

7. The method as claimed in claim 6 wherein the second physical fabric layer includes a plurality of perforations.

8. A method of cooling an object with a fabric having a front side and a back side, wherein the front side of the fabric is the side adjacent to the environment when the fabric is in use and the back side is the side adjacent to the object when the fabric is in use, the method comprising the steps of:

a. placing the fabric in contact with a liquid, wherein the fabric includes:
   i. a first functional zone of the back side configured to absorb moisture;
   ii. a second functional zone adjacent to the first functional zone configured to restrict the passage of liquid within the fabric;
   iii. a third functional zone adjacent to the second functional zone configured to absorb moisture; and
   iv. a fourth functional zone of the front side adjacent to the third functional zone configured to resist moisture absorption, wherein the fourth functional zone includes a plurality of fibers, wherein the plurality of fibers includes fibers formed of a hydrophobic material;
b. removing excess liquid from the fabric;
c. chilling the fabric; and
d. applying the chilled fabric to the object.

9. The method as claimed in claim 8 further comprising the step of anchoring the fabric about the object.

10. The method as claimed in claim 8 wherein the first and third functional zones of the fabric include a plurality of fibers, wherein the plurality of fibers includes fibers formed of a hydrophilic material.

11. The method as claimed in claim 8 wherein the second functional zone includes a plurality of fibers, wherein the plurality of fibers includes hollow fibers.

12. The method as claimed in claim 11 wherein the hollow fibers are formed of a hydrophilic material.

13. The method as claimed in claim 8 wherein the first, second and third functional zones of the fabric are established in a first physical fabric layer and the fourth functional zone is established in a second physical fabric layer.

14. The method as claimed in claim 13 wherein the second physical fabric layer includes a plurality of perforations.

* * * * *